US005857884A

United States Patent [19]

Zimlich

[11] Patent Number: 5,857,884

[45] Date of Patent: Jan. 12, 1999

[54] PHOTOLITHOGRAPHIC TECHNIQUE OF EMITTER TIP EXPOSURE IN FEDS

[75] Inventor: David Zimlich, Boise, Id.

[73] Assignee: Micron Display Technology, Inc., Boise, Id.

[21] Appl. No.: 598,236

[22] Filed: Feb. 7, 1996

[51] Int. Cl.[6] ..... H01J 9/02

[52] U.S. Cl. ..... 445/24

[58] Field of Search ..... 445/50, 24

[56] References Cited

U.S. PATENT DOCUMENTS

| | | | |
|---|---|---|---|
| 4,943,343 | 7/1990 | Bardai et al. | 445/24 |
| 5,049,520 | 9/1991 | Cathey | 437/60 |
| 5,228,877 | 7/1993 | Allaway et al. | 445/50 |
| 5,229,331 | 7/1993 | Doan et al. | 437/228 |
| 5,391,259 | 2/1995 | Cathey et al. | 156/643 |
| 5,499,938 | 3/1996 | Nakamoto et al. | 445/50 |

OTHER PUBLICATIONS

Yadon et al., "Mini–column silicon field–emitter arrays", J. Vac. Sci. Technol. B 13(2), Mar./Apr. 1995, pp. 580–584.

Busta, Heinz H., Review Vacuum microelectronics–1992, J. Micromech. Microeng. 2 (1992) 43–74.

*Primary Examiner*—Kenneth J. Ramsey

*Attorney, Agent, or Firm*—Hale and Dorr LLP

[57] ABSTRACT

Aligned gate structures for field emitter display devices are formed by overlaying a substrate, having at least one emitter tip thereon, successively with an insulating layer, a conductive layer, and a photoresist layer. The photoresist layer is then exposed to create fixed and unfixed regions. The unfixed regions are developed and etched to remove the conductive layer under the unfixed regions. The insulating layer is then etched to expose the emitter tips and the photoresist layer removed.

13 Claims, 1 Drawing Sheet

PHOTOLITHOGRAPHIC TECHNIQUE OF EMITTER TIP EXPOSURE IN FEDS

GOVERNMENT RIGHTS

This invention was made with Government support under Contract No. DABT63-93-C-0025 awarded by the Advanced Research Projects Agency (ARPA). The Government has certain rights in this invention.

BACKGROUND OF THE INVENTION

The present invention pertains to a method and system using photolithography to produce aligned emitter tips in field emission display devices.

Field emission display (FED) technology utilizes a matrix addressable array of pointed, thin film, cold field emission cathodes in combination with a phosphor luminescent screen, as represented by for example U.S. Pat. No. 5,210,472, the disclosure of which is incorporated herein by reference. An emission flat panel display operates on the principle of cathodoluminescent phosphors excited by cold cathode field emission electrons. A faceplate having a cathodoluminescent phosphor coating receives patterned electron bombardment from an opposing cathode member thereby providing a light image which can be seen by a viewer. The faceplate is separated from the cathode member by a vacuum gap and the two plates, in some embodiments, are prevented from collapsing together by physical standoffs or spacers fixed between them. In some embodiments, the cathode member is integrally formed with a baseplate, while in others, the cathode member is connected to the faceplate and a backplate surrounding the cathode member is sealed to the faceplate, and the vacuum exists between the faceplate and the backplate.

The cathode member of a field emission display is comprised of arrays of emission sites (emitters) which are typically sharp cones that produce electron emission in the presence of an intense electric field, an extraction grid disposed relative to the sharp emitters to provide the intense positive voltage for the electric field, and a means for addressing and activating the generation of electron beams from those sites. Varying the charge, which is delivered to the phosphor in a given pixel from an emission array, will vary the light output (brightness) of the pixel associated with it. The duration of the persistence is a material property which can be varied and controlled by the selection and syntheses of the phosphor materials used. Two techniques for varying the charge delivered by an emission array are either to vary the time period that the site is activated or alternatively to vary the emission current.

Fabrication of FEDs utilizes high resolution lithography and etching to create openings in a metal-dielectric sandwich. The extraction grids have been formed by a combination of deposition, polishing and wet etching. A silicon dioxide dielectric layer is deposited superadjacent to the emitter tips with a thickness such that the sum of the conductive layers with the previously deposited dielectric thickness is greater than tip height. The surface of the deposited conductive material is removed by a wet polishing process using an aqueous based slurry and a conforming polishing pad, known as the "CMP" or chemical-mechanical-planarizer process. For example, see U.S. Pat. No. 5,229,331, incorporated herein by reference. Such a CMP process produces self-aligned emitters due to the use of the tip itself as the reference from which subsequent steps are carried out. However, this process provides low yield due to the rough treatment inherent in the CMP process.

Therefore, there is a need for a process for manufacturing emitter tips that results in a higher yield than the traditional CMP process, while still giving acceptable yields.

To illustrate this process, FIG. 1 shows a CMP process of forming an emitter tip and grid structure wherein the tip 10 is formed by placing a photoresist mask or cap 12 over the substrate 14 which is then etched, according to processes known in the art, to removed the portion shown in broken lines to form emitter tip 10. The etching occurs more slowly under the mask or cap, thus generating the tip 10. For example, see U.S. Pat. No. 5,391,259, incorporated herein by reference. Next the mask or cap 12 is removed and the tip 10 is further sharpened by known processes (not shown).

Referring now to FIG. 2, after the tip 10 has been sharpened, a layer of insulator (for example silicon dioxide) 16 is laid over the tip 10 and a grid layer 18 of, for example, alpha silicon is also laid over the tip. Next, chemical-mechanical-planarization is performed at the level of dashed line 20.

Referring now to FIG. 3, an etch that is selective for the silicon dioxide layer 16 is used to expose emitter tip 10. Thus an aligned gate-emitter structure is generated. However, as discussed above, the disadvantage in the above mentioned chemical mechanical planarization method is that it is a very rugged and destructive process. An alternative prior art method of forming a gate structure uses a nitride cap (not shown) throughout the process of forming the grid. For example see U.S. Pat. No. 5,049,520, incorporated herein by reference. The disadvantage of using a nitride cap is that the cap must be balanced on an emitter tip. Should the cap fall during formation of the gate, it cannot be easily removed and the entire structure may have to be abandoned and scrapped. According to the present invention these disadvantages are avoided.

SUMMARY OF THE INVENTION

The present invention concerns a method for forming aligned gate structures for FEDs by forming at least one emitter, overlaying an insulating layer, overlaying a conductive layer, overlaying a photoresist layer, exposing the photoresist layer to create fixed and unfixed regions, developing the exposed region, etching to remove the metal layer under the exposed region, etching the insulator to expose the emitter tip, and removing the remaining photoresist layer.

BRIEF DESCRIPTION OF THE DRAWINGS

The present invention will now be described, by way of example, with reference to the accompanying drawings, in which.

DETAILED DESCRIPTION OF AN ILLUSTRATIVE EMBODIMENT

Figure 4:
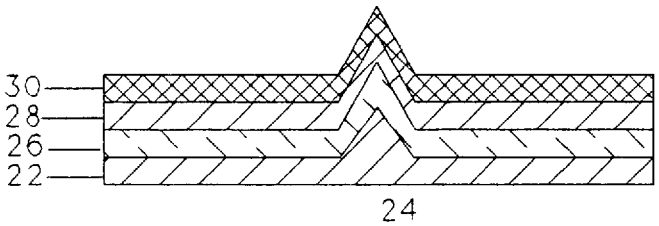
FIG. 4 is a cross section through an section of a FED substrate formed in accordance with the present invention.
Figure 5:
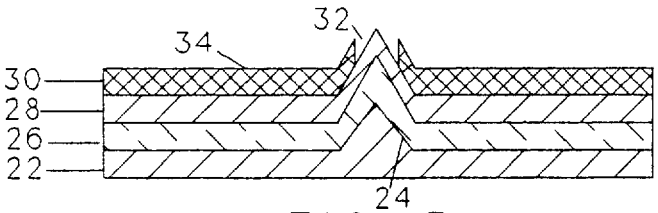
FIG. 5 is a cross section through an section of a FED substrate during manufacture in accordance with the present invention.
Figure 6:
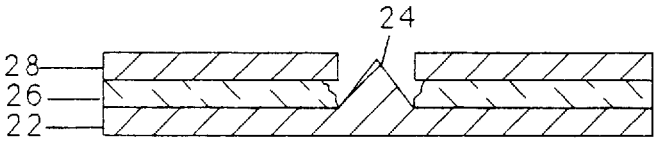
FIG. 6 is a cross section through an section of a FED substrate formed in accordance with the present invention.

Referring to FIG. 4, which illustrates the first step of an embodiment of the present invention, substrate 22 and emitter tip 24 are overlaid with insulative layer 26 and conductive layer 28. Next photoresist layer 30 is applied over conductive layer 28, masked and exposed to light, thus creating unfixed region 32 and fixed region 34. After developing exposed or unfixed region 32, a portion of conductive layer 28 is uncovered, as shown in FIG. 5. Next an anisotropic etch is applied to remove that portion of conductive layer 28 under exposed region 32. According to one embodiment, the fixed photoresist 34 is left in place and an etch, which is selective for insulator 26, is used to expose emitter tip 24, as seen in FIG. 6. Next the photoresist layer 30 is removed and a aligned gate structure, as seen in FIG. 6, is the result.

Figure 1:
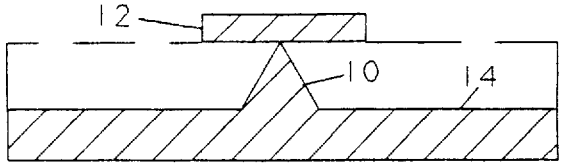
FIG. 1 PRIOR ART
FIG. 1 is a cross section through an FED substrate formed in accordance with the prior art.
Figure 2:
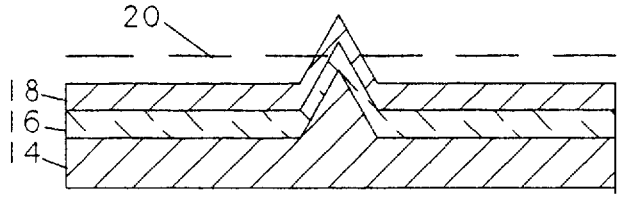
FIG. 2 PRIOR ART
FIG. 2 is a cross section through an section of a FED substrate during manufacture in accordance with the prior art.
Figure 3:
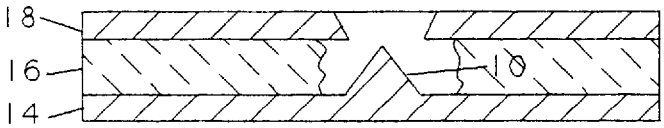
FIG. 3 PRIOR ART
FIG. 3 is a cross section through an section of a FED substrate formed in accordance with the prior art.

According to one embodiment of the invention the same mask (not shown) that is used to apply photoresist cap 12 (FIG. 1) is used to form a shadow mask for fixing photoresist layer 30. Any misalignment caused according to the present process will not affect overall FED performance. If the grid etch rate is isotropic enough, the misalignment may be negligible. And, since the tip location is known, the photoresist above each tip is opened to etch the grid. Then the oxide is stripped away using the same photo step.

The present invention bypasses the current most damaging step in earlier processing, namely chemical-mechanical-planarization, and increases yield.

While the above described embodiment of the present invention refers to only applying two layers, namely an insulator and a conductor, to the substrate, the invention is not so limited. The method for forming aligned gate structures on a substrate can continue with overlaying with a third layer, coating the third layer with a second photoresist, exposing second photoresist layer to create fixed and unfixed regions, etching the second photoresist to remove the third layer and expose the tips. This process can be repeated for as many times as required to achieve the desired structure.

In another example, the substrate could be layered with a first oxide layer and a second conductive layer. This would then be coated with a photoresist, exposed to create fixed and unfixed regions, etched to remove the conductive layer, and the photoresist removed. The resulting assembly would then be layered with another oxide layer and photoresist and the photo etching process repeated. This assembly would then be layered with a grid and photoresist and again processed to expose the tips and remove the photoresist.

The present invention may be subject to many modifications and changes without departing from the spirit or essential characteristics thereof. The present embodiment should therefore be considered in all respects as being illustrative and not restrictive of the scope of the invention as defined by the appended claims.

I claim:

1. A method for forming structures for field emission display devices comprising:

providing a substrate;

using a mask to form a cap over a portion of said substrate;

forming an emitter tip under said cap;

overlaying said substrate and tip with a first layer;

overlaying said first layer with a second layer;

overlaying said second layer with a photoresist layer;

using said mask to expose said photoresist layer to create an unfixed region over said tip;

removing the unfixed region;

etching to remove the second layer under the unfixed region;

etching the first layer to expose the emitter tip; and removing the photoresist layer.

2. A method according to claim 1 wherein said first layer is an insulative material.

3. A method according to claim 1 wherein said second layer is conductive.

4. A method according to claim 3 wherein said second layer is formed from a doped semi conductor material.

5. A method according to claim 3 wherein said second layer is formed from a metal.

6. A method according to claim 1 wherein an etchant is used to remove the second layer under the unfixed region.

7. A method according to claim 1 wherein additional layers are applied to said substrate and the steps of overlaying a photoresist layer, exposing said photoresist layer, developing unfixed regions, etching to remove the layer under the unfixed regions and removing the photoresist are repeated in proper sequence for each successive layer.

8. A method for forming structures for field emission display devices, comprising:

providing a substrate;

using a mask to form a cap over a portion of said substrate;

forming an emitter tip under said cap;

overlaying said substrate and tip with a first layer;

overlaying said first layer with a second layer;

overlaying said second layer with a first photoresist layer;

using said mask to expose said first photoresist layer to create an unfixed region over said tip;

etching said first photoresist layer to remove said second layer under said unfixed region;

overlaying with a third layer;

coating said third layer with a second photoresist;

exposing second photoresist layer to create fixed and unfixed regions;

etching said second photoresist to remove said third layer and expose the tip.

9. A method according to claim 8 wherein said second layer is formed from a doped semi conductor material.

10. A method according to claim 8 wherein said second layer is formed from a metal.

11. A method according to claim 8 wherein an etchant is used to remove the second layer under the unfixed region.

12. A method according to claim 8 wherein the steps of overlaying a photoresist layer, exposing said photoresist layer, developing unfixed regions, etching to remove the layer under the unfixed regions are repeated in proper sequence at least once.

13. A method for forming structures for field emission display devices comprising:

generating a first mask;

providing a substrate;

using one of said first mask and a mask derived from said first mask to form a cap over a portion of said substrate;

forming an emitter tip under said cap;

forming a first layer over said substrate and tip;

forming a second layer over said first layer;

forming a photoresist layer over said second layer;

using one of said first mask and a mask derived from said first mask to expose said photoresist layer to create an unfixed region over said tip;

removing the unfixed region;

removing the second layer under the unfixed region; and removing the first layer under the unfixed region.

* * * * *